US011086241B2

(12) United States Patent
Kuno et al.

(10) Patent No.: US 11,086,241 B2
(45) Date of Patent: Aug. 10, 2021

(54) ELECTROPHOTOGRAPHIC PHOTORECEPTOR, PROCESS CARTRIDGE, AND ELECTROPHOTOGRAPHIC APPARATUS

(71) Applicant: CANON KABUSHIKI KAISHA, Tokyo (JP)

(72) Inventors: Jumpei Kuno, Yokohama (JP); Akira Sakakibara, Susono (JP); Yota Ito, Mishima (JP); Shuhei Iwasaki, Yokohama (JP); Kohei Makisumi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/788,134

(22) Filed: Feb. 11, 2020

(65) Prior Publication Data

US 2020/0264525 A1 Aug. 20, 2020

(30) Foreign Application Priority Data

Feb. 18, 2019 (JP) ..... JP2019-026909
Jan. 27, 2020 (JP) ..... JP2020-011253

(51) Int. Cl.

| | |
|---|---|
| ***G03G 5/00*** | (2006.01) |
| ***G03G 5/047*** | (2006.01) |
| ***G03G 5/05*** | (2006.01) |
| ***G03G 5/06*** | (2006.01) |
| ***G03G 5/14*** | (2006.01) |

(52) U.S. Cl.

CPC ..... *G03G 5/047* (2013.01); *G03G 5/0525* (2013.01); *G03G 5/0571* (2013.01); *G03G 5/0578* (2013.01); *G03G 5/0696* (2013.01); *G03G 5/144* (2013.01)

(58) Field of Classification Search

CPC ..... G03G 5/144; G03G 5/0696
USPC ..... 430/60, 63, 65
See application file for complete search history.

(56) References Cited

U.S. PATENT DOCUMENTS

| | | | | |
|---|---|---|---|---|
| 10,831,117 | B2 * | 11/2020 | Sakakibara | G03G 5/0696 |
| 2010/0330474 | A1 * | 12/2010 | Fujiwara | G03G 5/0679 430/56 |
| 2016/0154329 | A1 * | 6/2016 | Kawaguchi | G03G 5/144 399/111 |

FOREIGN PATENT DOCUMENTS

| | | | |
|---|---|---|---|
| JP | 2002-287396 | A | 10/2002 |
| JP | 2003-262968 | A | 9/2003 |
| JP | 2008-250084 | A | 10/2008 |
| JP | 2009-151329 | A | 7/2009 |
| JP | 2016-028266 | A | 2/2016 |

* cited by examiner

*Primary Examiner* — Mark A Chapman
(74) *Attorney, Agent, or Firm* — Canon U.S.A., Inc., IP Division

(57) ABSTRACT

An electrophotographic photoreceptor includes a support, an undercoat layer placed on the support, a charge generation layer placed on the undercoat layer, and a charge transport layer placed on the charge generation layer. The undercoat layer contains titanium oxide particles surface-treated with an organosilicon compound that is at least one member selected from the group consisting of compounds represented by formulas (1) to (8) and a polyamide resin. The charge generation layer contains hydroxygallium phthalocyanine.

12 Claims, 1 Drawing Sheet

ELECTROPHOTOGRAPHIC PHOTORECEPTOR, PROCESS CARTRIDGE, AND ELECTROPHOTOGRAPHIC APPARATUS

BACKGROUND OF THE INVENTION

Field of the Invention

The present disclosure relates to an electrophotographic photoreceptor, a process cartridge including the electrophotographic photoreceptor, and an electrophotographic apparatus.

Description of the Related Art

Electrophotographic photoreceptors containing an organic photoconductive substance (charge generation material) are used as electrophotographic photoreceptors mounted in process cartridges or electrophotographic apparatuses. An electrophotographic photoreceptor generally includes a support and a photosensitive layer placed on the support. The photosensitive layer contains a charge generation material and a charge transport material.

Among photosensitive layers, a multilayer photosensitive layer including a charge generation layer containing a charge generation material and a charge transport layer which contains a charge transport material and which is placed on the charge generation layer is successfully used. Furthermore, an undercoat layer is often placed between a support and a photosensitive layer for the purpose of increasing the adhesion between the support and the positive side and the purpose of electrostatic stability during repeated use.

In order to achieve the above purposes, an undercoat layer containing a polyamide resin and surface-treated titanium oxide particles dispersed therein is used. Japanese Patent Laid-Open No. 2002-287396 (hereinafter referred to as Patent Document 1) discloses a technique in which black spots are improved in such a manner that titanium oxide particles are primarily treated (silica-alumina or the like) and are secondarily treated (a reactive organosilicon compound or the like) such that the hydrophobicity thereof is adjusted. Japanese Patent Laid-Open No. 2009-151329 (hereinafter referred to as Patent Document 2) discloses a technique in which a polyamide resin and surface-treated titanium oxide are used in an undercoat layer and gallium phthalocyanine is used as a charge generation material.

SUMMARY OF THE INVENTION

Accordingly, the present disclosure provides an electrophotographic photoreceptor including a support, an undercoat layer placed on the support, a charge generation layer placed on the undercoat layer, and a charge transport layer placed on the charge generation layer. The undercoat layer contains titanium oxide particles surface-treated with an organosilicon compound that is at least one member selected from the group consisting of compounds represented by formulas (1) to (8) below and a polyamide resin. The charge generation layer contains hydroxygallium phthalocyanine.

(1)

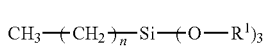

(2)

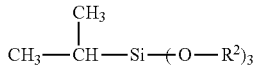

(3)

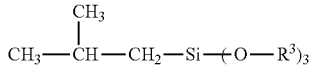

(4)

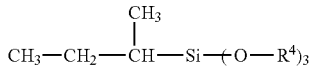

(5)

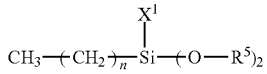

(6)

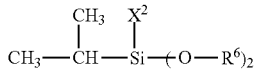

(7)

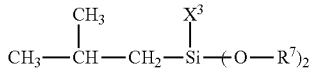

(8)

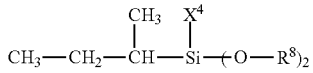

In formulas (1) to (8), $R^1$ to $R^8$ each independently represent a methyl group, an ethyl group, or an acetyl group; $X^1$ to $X^4$ each independently represent a hydrogen atom or a methyl group; and n represents an integer of 1 to 3.

The present disclosure provides a process cartridge which integrally supports the electrophotographic photoreceptor and at least one selected from the group consisting of a charging unit, a developing unit, and a cleaning unit and which is attachable to or detachable from a main body of an electrophotographic apparatus.

Furthermore, the present disclosure provides an electrophotographic apparatus including the electrophotographic photoreceptor, a charging unit, an exposure unit, a developing unit, and a transfer unit.

Further features of the present disclosure will become apparent from the following description of exemplary embodiments with reference to the attached drawings.

DESCRIPTION OF THE EMBODIMENTS

Figure 1:
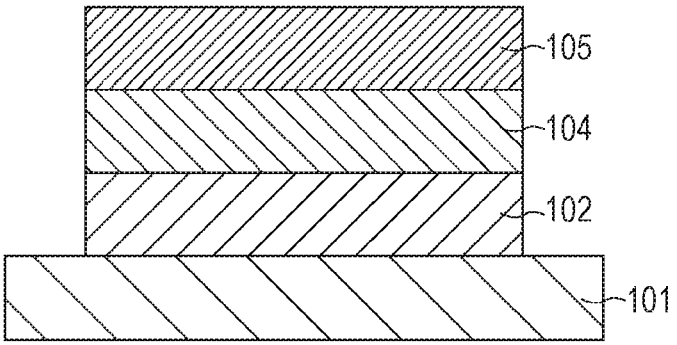
FIG. 1 is an illustration showing an example of the layer configuration of an electrophotographic photoreceptor according to an embodiment of the present disclosure.

In recent years, the reduction of the toner consumption amount is necessary in addition to the suppression of an electric potential change for the sake of further running cost saving and downsizing. Therefore, the suppression of the electric potential change at a high level and the suppression of a phenomenon (hereinafter also referred to as "fogging") in which toner is developed in a blank portion are required.

The inventors have carried out investigations and, as a result, have found that the technique disclosed in each of Patent Documents 1 and 2 is not sufficient to suppress the electric potential change and fogging in long-term repeated use and therefore the toner consumption amount is increased in some cases.

It is an aspect of the present disclosure to provide an electrophotographic photoreceptor which suppresses an electric potential change due to long-term repeated use and fogging and which suppresses the toner consumption amount, a process cartridge including the electrophotographic photoreceptor, and an electrophotographic apparatus.

An electrophotographic photoreceptor according to an embodiment of the present disclosure includes a support, an undercoat layer placed on the support, a charge generation layer placed on the undercoat layer, and a charge transport layer placed on the charge generation layer. The undercoat layer contains titanium oxide particles surface-treated with an organosilicon compound that is at least one selected from compounds represented by Formulas (1) to (8) below and a polyamide resin. The charge generation layer contains hydroxygallium phthalocyanine.

(1)

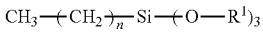

(2)

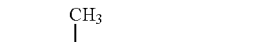

(3)

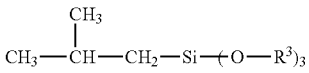

(4)

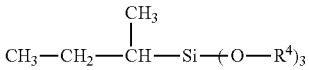

(5)

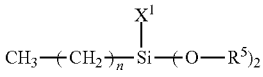

(6)

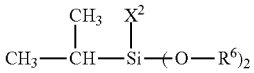

(7)

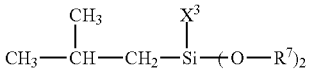

(8)

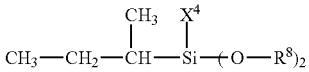

In Formulas (1) to (8), $R^1$ to $R^8$ each independently represent a methyl group, an ethyl group, or an acetyl group; $X^1$ to $X^4$ each independently represent a hydrogen atom or a methyl group; and n represents an integer of 1 to 3.

The inventors infer the reason why the electrophotographic photoreceptor suppresses an electric potential change due to long-term repeated use and fogging and also suppresses the toner consumption amount as described below.

The suppression of fogging is important in suppressing the toner consumption amount. This is because fogging leads to the unnecessary consumption of toner, is increased by the influence of long-term repeated use, and is required to be improved. As a result of investigations, the inventors have found that this disadvantage is significant particularly in a high-temperature, high-humidity environment.

The electrophotographic photoreceptor suppresses fogging in a high-temperature, high-humidity environment. The cause of the occurrence of fogging is probably that moisture present at the interface between the charge generation layer and the undercoat layer causes the local injection of charge.

In this embodiment, since the undercoat layer, which contains the titanium oxide particles surface-treated with the organosilicon compound that is at least one selected from the compounds represented by Formulas (1) to (8), is combined with the charge generation layer, which contains hydroxygallium phthalocyanine, moisture present at the interface therebetween migrates to the charge generation layer side. Therefore, it is inferred that the local injection of charge is unlikely to occur and fogging is suppressed. In a case where surface treatment is performed using an organosilicon compound, such as methyltrimethoxysilane, containing a small number of carbon atoms, hydrophobization is insufficient, the advantage that moisture migrates is insufficient, and no sufficient advantage is obtained. However, in a case where surface treatment is performed using an organosilicon compound, such as hexyltrimethoxysilane, containing a large number of carbon atoms, the bulkiness of this organosilicon compound reduces the amount of this organosilicon compound reacting with the surface of titanium oxide and unreacted OH groups remain on the surface thereof. Therefore, the advantage that moisture migrates is insufficient and no sufficient advantage is obtained.

On the other hand, the suppression of an electric potential (light area potential) change is also important in suppressing the toner consumption amount. The light area potential is set for the purpose of achieving desired image density. In a case where the light area potential varies significantly, the light area potential needs to be set such that the minimum density is ensured for the purpose of ensuring the quality of an image. This results in an increase in opportunity to develop an image with excessive density, leading to an increase in toner consumption amount.

In order to suppress an electric potential change due to long-term repeated use, the accumulation of charge needs to be suppressed. In order to suppress the accumulation of charge remaining in the undercoat layer, it is preferable that the titanium oxide particles are uniformly dispersed in the undercoat layer and are covered with no long-chain alkyl groups or no high-electrical resistance material such as alumina. It is conceivable that selecting one organosilicon compound from the compounds represented by Formulas (1) to (8) enables the surface hydrophobicity of the titanium oxide particles to be enhanced without being covered with any high-electrical resistance material, enables the titanium oxide particles to be uniformly dispersed, and allows the accumulation of charge to be suppressed.

As described above, in order to suppress the toner consumption amount, the electric potential change due to long-term repeated use and fogging need to be suppressed. In order to achieve these, the electrophotographic photoreceptor has a configuration in which the undercoat layer, which contains the titanium oxide particles surface-treated with the organosilicon compound that is at least one selected from the compounds represented by Formulas (1) to (8) and the polyamide resin, and the charge generation layer, which contains hydroxygallium phthalocyanine, are stacked.

The electrophotographic photoreceptor includes the support, the undercoat layer, which is placed on the support; the charge generation layer, which is placed on the undercoat layer; and the charge transport layer, which is placed on the charge generation layer.

FIG. 1 is an illustration showing an example of the layer configuration of the electrophotographic photoreceptor. As shown in FIG. 1, the electrophotographic photoreceptor includes a support 101, an undercoat layer 102, a charge generation layer 104, and a charge transport layer 105.

Support

The support 101 is preferably one having conductivity (a conductive support) and may be a support made of, for example, metal such as aluminium, iron, nickel, copper, or gold or an alloy of the metal. Examples of the support 101 include supports obtained by forming a thin film of metal such as aluminium, chromium, silver, or gold on an insulating member made of a polyester resin, a polycarbonate resin, a polyimide resin, or glass and supports obtained by forming a thin film of a conductive material such as indium oxide or tin oxide on such an insulating member. A surface of the support 101 may be subjected to electrochemical treatment such as anodic oxidation, wet honing, blasting, cutting, or the like for the purpose of improving electrical properties and the purpose of suppressing interference fringes.

A conductive layer may be placed between the support 101 and the undercoat layer 102. The conductive layer is obtained in such a manner that a coating film of a conductive layer coating solution containing resin and conductive particles dispersed therein is formed on the support 101 and is then dried.

Undercoat Layer

The undercoat layer 102 is placed between the support 101 and the charge generation layer 104.

The undercoat layer 102 contains the polyamide resin and the titanium oxide particles, which are surface-treated with the organosilicon compound that is at least one selected from the compounds represented by Formulas (1) to (8).

The polyamide resin is preferably one soluble in alcoholic solvents. The polyamide resin used is preferably, for example, ternary (6-66-610) copolymerized polyamide, quaternary (6-66-610-12) copolymerized polyamide, N-methoxymethylated nylon, fatty acid-based polyamide, a fatty acid-based polyamide block copolymer, or copolymerized polyamide containing a diamine component.

From the viewpoint of suppressing the accumulation of charge, the titanium oxide particles preferably have a rutile or anatase crystal structure and are more preferably rutile titanium oxide particles which have low photocatalytic activity. When the titanium oxide particles are such rutile titanium oxide particles, the titanium oxide particles preferably have a rutile fraction of 90% or more. The titanium oxide particles preferably have a spherical shape.

From the viewpoint of suppressing the accumulation of charge and the viewpoint of uniform dispersibility, the average primary particle size of the titanium oxide particles, which are surface-treated with the organosilicon compound, is preferably 0.006 μm to 0.180 μm and more preferably 0.015 μm to 0.085 μm.

The organosilicon compound, which is used to surface-treat the titanium oxide particles, is preferably the compound represented by Formula (1) or (5) from the viewpoint of the uniformity of surface treatment. In Formula (1) or (5), n is more preferably 1 or 2. In particular, the organosilicon compound is more preferably at least one selected from the group consisting of n-ethyltrimethoxysilane, n-ethyltriethoxysilane, n-ethylmethyldimethoxysilane, n-propyltrimethoxysilane, n-propyltriethoxysilane, and n-propylmethyldimethoxysilane.

The titanium oxide particles, which are surface-treated with the organosilicon compound, are preferably treated with no alumina. Alternatively, when the titanium oxide particles are treated with alumina, the abundance of Al is preferably 0.50% or less.

In the undercoat layer 102, the following expression is preferably satisfied:

$$0.010 \leq a \times b \leq 0.050 \quad \text{(A)}$$

where b (%) is the element ratio of Si in the organosilicon compound to Ti in the titanium oxide particles and a (μm) is the average primary particle size of the titanium oxide particles, which are surface-treated with the organosilicon compound. Expression (A) gives a value corresponding to the surface treatment amount with the organosilicon compound.

In the undercoat layer 102, the following expression is preferably satisfied:

$$14.0 \leq c/a \leq 21.0 \quad \text{(B)}$$

where c is the volume ratio of the titanium oxide particles, which are surface-treated with the organosilicon compound, to the polyamide resin. This is because two effects, that is, the effect of suppressing the accumulation of charge remaining in the undercoat layer 102 and the effect of suppressing the fogging of the electrophotographic photoreceptor can be achieved at a high level.

The volume ratio c of the titanium oxide particles, which are surface-treated with the organosilicon compound, to the polyamide resin is preferably from 0.2 to 1.0 and more preferably from 0.3 to less than 0.8. When the volume ratio c is less than 0.2, the effect of suppressing the accumulation of charge is not sufficiently obtained in this embodiment in some cases. When the volume ratio c is more than 1.0, the effect of suppressing fogging is not sufficiently obtained in this embodiment in some cases.

The thickness (μm) of the undercoat layer 102 preferably satisfies the following expression:

$$0.5 \leq d \leq 3.0 \quad \text{(C)}$$

where d is the thickness (μm) of the undercoat layer 102. When d in Expression (C) is 0.5 or more, the effect of suppressing the fogging of the electrophotographic photoreceptor is high. When d in Expression (C) is 3.0 or less, the effect of suppressing the accumulation of charge remaining in the undercoat layer 102 is high.

Furthermore, the following expression is preferably satisfied:

$$0.15 \leq c/d \leq 0.55 \quad \text{(D).}$$

Simultaneously satisfying Expressions (A) and (D) enables two effects, that is, the effect of suppressing the fogging of the electrophotographic photoreceptor and the effect of suppressing the accumulation of charge remaining in the undercoat layer 102 to be achieved at a high level.

In this embodiment, the undercoat layer 102 may further contain organic particles or an additive such as a leveling agent for the purpose of increasing the effect of preventing interference fringes of the electrophotographic photoreceptor or the purpose of increasing the formability of the undercoat layer 102. Incidentally, the content of the additive in the undercoat layer 102 is preferably 10% by mass or less with respect to the total mass of the undercoat layer 102.

Charge Generation Layer

The charge generation layer 104, which contains hydroxygallium phthalocyanine, is placed directly on the undercoat layer 102.

Hydroxygallium phthalocyanine is preferably a hydroxygallium phthalocyanine crystal having peaks at Bragg angles (2θ±0.2°) of 7.4° and 28.3° in Cu Kα characteristic X-ray diffraction.

The charge generation layer 104 preferably further contains a thermoplastic resin which contains a hydroxy group and which has a hydroxyl value of 50 mg-KOH/g or more. Examples of the thermoplastic resin include polyvinyl acetal resins such as a polyvinyl butyral resin, polyolefin resins such as an ethylene-vinyl alcohol copolymer resin, and polyol resins such as a polyester polyol resin. In this embodiment, in order to enhance the effect of suppressing the delamination of a photosensitive layer, the thermoplastic resin more preferably has a hydroxyl value of 100 mg-KOH/g. The weight-average molecular weight of the thermoplastic resin, which contains the hydroxy group and has a hydroxyl value of 50 mg-KOH/g or more, is preferably within the range of 5,000 to 400,000.

In the charge generation layer 104, the mass ratio (charge generation material/binding resin ratio) of a charge generation material to a binding resin is preferably within the range of 10/1 to 1/10 and more preferably within the range of 5/1 to 1/5.

The charge generation layer 104 preferably has a thickness of 0.05 μm to 5 μm.

Examples of a solvent for use in a charge generation layer coating solution include alcoholic solvents, sulfoxide solvents, ketone solvents, ether solvents, ester solvents, and aromatic hydrocarbon solvents.

Charge Transport Layer

The charge transport layer 105 is placed on the charge generation layer 104.

Examples of a charge transport material for use in the charge transport layer 105 include polycyclic aromatic compounds, heterocyclic compounds, hydrazone compounds, styryl compounds, benzidine compounds, triarylamine compounds, triphenylamine, and polymers having main or side chains containing groups derived from these compounds.

Examples of a binding resin for use in the charge transport layer 105 include polyester resins, polycarbonate resins, polymethacrylate resins, polyarylate resins, polysulfone resins, and polystyrene resins. Among these, the polycarbonate resins and the polyarylate resins are preferable. The weight-average molecular weight of the binding resin is preferably within the range of 10,000 to 300,000.

In the charge transport layer 105, the mass ratio (charge transport material/binding resin ratio) of the charge generation material to the binding resin is preferably within the range of 10/5 to 5/10 and more preferably within the range of 10/8 to 6/10. The charge transport layer 105 preferably has a thickness of 5 μm to 40 μm and more preferably 15 μm to 25 μm.

Examples of a solvent for use in a charge transport layer coating solution include alcoholic solvents, sulfoxide solvents, ketone solvents, ether solvents, ester solvents, and aromatic hydrocarbon solvents.

A protection layer (surface protection layer) containing conductive particles or the charge transport material and a binding resin may be placed on the charge transport layer 105. The protection layer may further contain an additive such as a lubricant. The binding resin in the protection layer may have conductivity or charge transportability. In this case, the protection layer need not contain the conductive particles or the charge transport material except the binding resin. The binding resin in the protection layer may be a thermoplastic resin or a cured resin cured with heat, light, radiation such as an electron beam, or the like.

A method for forming each of layers, such as the conductive layer, the undercoat layer 102, the charge generation layer 104, and the charge transport layer 105, forming the electrophotographic photoreceptor is preferably a method below. That is, each layer is formed in such a manner that a coating film is formed by applying a coating solution obtained by dissolving and/or dispersing materials making up the layer in a solvent and the obtained coating film is dried and/or is cured. Examples of a method for applying the coating solution include a dip application method (dip coating method), a spray coating method, a curtain coating method, a spin coating method, and a ring coating method. Among these, the dip application method is preferable from the viewpoint of efficiency and productivity.

Process Cartridge and Electrophotographic Apparatus

Figure 2:
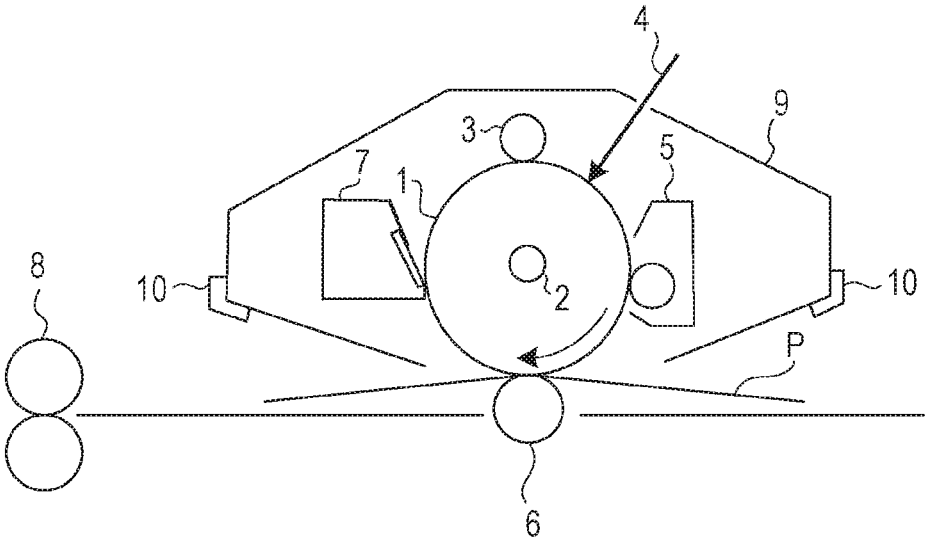
FIG. 2 is an illustration showing the schematic configuration of an electrophotographic apparatus including a process cartridge including the electrophotographic photoreceptor shown in FIG. 1.

FIG. 2 shows an example of the schematic configuration of an electrophotographic apparatus including a process cartridge including the electrophotographic photoreceptor.

As shown in FIG. 2, the electrophotographic apparatus includes a cylindrical electrophotographic photoreceptor 1 and the electrophotographic photoreceptor 1 is rotationally driven about a shaft 2 at a predetermined circumferential velocity in an arrow direction. A surface (peripheral surface) of the electrophotographic photoreceptor 1, which is rotationally driven, is uniformly charged to a predetermined positive or negative potential by a charging unit 3 (a primary charging mechanism such as a charging roller). Next, the uniformly charged surface of the electrophotographic photoreceptor 1 is exposed to exposure light (image exposure light) 4 from an exposure unit (not shown) such as a slit exposure unit or a laser beam scanning exposure unit. In this manner, electrostatic latent images corresponding to target images are sequentially formed on the surface of the electrophotographic photoreceptor 1.

An electrostatic latent image formed on the surface of the electrophotographic photoreceptor 1 is then developed into a toner image by toner contained in a developer in a developing unit 5. The toner image formed and borne on the surface of the electrophotographic photoreceptor 1 is transferred to a transfer material P such as paper by transfer bias from a transfer unit 6 such as a transfer roller. The transfer material P is taken from a transfer material supply unit (not shown) to a portion (contact portion) between the electrophotographic photoreceptor 1 and the transfer unit 6 in synchronization with the rotation of the electrophotographic photoreceptor 1 and is fed.

The transfer material P provided with the transferred toner image is separated from the surface of the electrophotographic photoreceptor 1, is introduced into a fixing unit 8 such that the toner image is fixed, and is then discharged outside the electrophotographic apparatus in the form of an image-formed product (print or copy).

After the transfer of the toner image, the surface of the electrophotographic photoreceptor 1 is cleaned with a cleaning unit 7 such as cleaning blade by removing the untransferred developer (untransferred toner). Next, after being charge-eliminated with pre-exposure light (not shown) from a pre-exposure unit (not shown), the surface of the electrophotographic photoreceptor 1 is repeatedly used to form an image. When the charging unit 3 is a contact charging unit including a charging roller or the like as shown in FIG. 2, pre-exposure light is not necessarily required.

Some selected from components such as the electrophotographic photoreceptor 1, the charging unit 3, the developing unit 5, the transfer unit 6, and the cleaning unit 7 are housed in a container and are integrally supported in the form of a process cartridge. The process cartridge can be configured so as to be attachable to or detachable from a main body of the electrophotographic apparatus, such as a copier or a laser beam printer. Referring to FIG. 2, the electrophotographic photoreceptor 1, the charging unit 3, the developing unit 5, and the cleaning unit 7 are integrally supported into a cartridge, whereby a process cartridge 9 which is attachable to or detachable from the main body of the electrophotographic apparatus using a guiding unit 10 such as a rail is formed.

EXAMPLES

The present disclosure is further described below in detail with reference to examples and comparative examples. The present invention is not limited to the examples. In the examples and the comparative examples, the term "parts" refers to "parts by mass".

Example 1

An aluminium cylinder (JIS H 4000:2006 A3003P, an aluminium alloy) having a length of 260.5 mm and a diameter of 30 mm was cut (JIS B 0601:2014, a 10-point average roughness Rzjis of 0.8 μm). The cut aluminium cylinder was used as a support (conductive support).

Next, 100 parts of rutile titanium oxide particles (an average primary particle size of 50 nm, produced by TAYCA Corporation) were mixed with 500 parts of toluene and 5.0 parts of ethyltrimethoxysilane, in which in Formula (1), $R^1$ is a methyl group and n=1, was added to the mixture, followed by agitation for eight hours. Thereafter, toluene was distilled off at a reduced pressure, followed by drying at 120° C. for three hours, whereby the rutile titanium oxide particles surface-treated with ethyltrimethoxysilane were obtained.

To a solvent mixture of 90 parts of methanol and 60 parts of 1-butanol, 18 parts of the rutile titanium oxide particles surface-treated with ethyltrimethoxysilane, 4.5 parts of N-methoxymethylated nylon (trade name: Toresin EF-30T, produced by Nagase ChemteX Corporation), and 1.5 parts of a copolymer nylon resin (trade name: AMILAN CM8000, produced by Toray Industries Inc.) were added, whereby a dispersion was prepared.

The dispersion was subjected to dispersion treatment for five hours in a vertical sand mill using glass beads with a diameter of 1.0 mm, whereby an undercoat layer coating solution was prepared. The undercoat layer coating solution was applied to the support by dip coating, followed by drying an obtained coating film at 100° C. for ten minutes, whereby an undercoat layer with a thickness of 2.0 μm was formed.

In the undercoat layer, parameters and expressions were as follows: a=0.050, b=0.50, c=0.78, d=2.0, a×b=0.025, c/a=15.6, and c/d=0.39. The value of a was determined from a microscopic image in such a manner that after an electrophotographic photoreceptor was prepared, a cross section of the electrophotographic photoreceptor was observed with a field emission scanning electron microscope (FE-SEM, trade name: S-4800, manufactured by Hitachi High-Technologies Corporation). The value of b was determined in such a manner that after the rutile titanium oxide particles surface-treated with ethyltrimethoxysilane were prepared, element ratio was determined by converting the content (mass percent) of Si with respect to $TiO_2$ with software (SpectraEvaluation, version 5.0L) by supposing that detected Ti only was an oxide from results obtained by analyzing the rutile titanium oxide particles surface-treated with ethyltrimethoxysilane using a wavelength-dispersive X-ray fluorescence analyzer (XRF, trade name: Axios advanced, manufactured by PANalytical B.V.).

Next, crystals of hydroxygallium phthalocyanine (charge generation material) with a crystal form having peaks at Bragg angles (2θ±0.2°) of 7.5°, 9.9°, 12.5°, 16.3°, 18.6°, 25.1°, and 28.3° in Cu Kα characteristic X-ray diffraction were prepared. Into a vertical sand mill containing glass beads with a diameter of 1.0 mm, ten parts of the hydroxygallium phthalocyanine crystals, five parts of a polyvinyl butyral resin (trade name: S-LEC BX-1, a hydroxyl value of 173 mg-KOH/g, produced by Sekisui Chemical Co., Ltd.), and 260 parts of cyclohexanone were put, followed by dispersion treatment for 1.5 hours. Next, 240 parts of ethyl acetate was added to this dispersion, whereby a charge generation layer coating solution was prepared. The charge generation layer coating solution was applied to the undercoat layer by dip coating, followed by drying an obtained coating film at 80° C. for ten minutes, whereby a charge generation layer with a thickness of 0.25 μm was formed.

Next, ten parts of an amine compound (charge transport material) represented by Formula (CTM-1) below and ten parts of a polyarylate resin, containing a structural unit represented by Formula (CTB-1) below and a structural unit represented by Formula (CTB-2) at a ratio of 5/5, having a weight-average molecular weight of 100,000 were dissolved in a solvent mixture of 30 parts of dimethoxymethane and 70 parts of chlorobenzene, whereby a charge transport layer coating solution was prepared. The charge transport layer coating solution was applied to the charge generation layer by dip coating, followed by drying an obtained coating film at 120° C. for 60 minutes, whereby a charge transport layer with a thickness of 20 μm was formed.

(CTM-1)

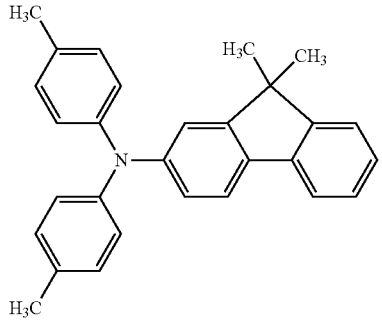

(CTB-1)

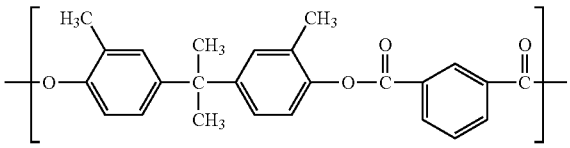

(CTB-2)

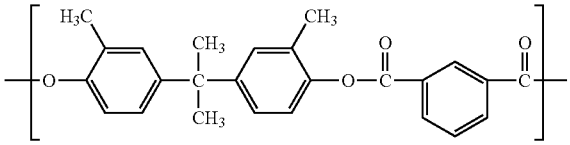

As described above, the electrophotographic photoreceptor, which included the support, the undercoat layer, the charge generation layer, and the charge transport layer, was manufactured.

Evaluation of Fogging

A laser beam printer (trade name: HP LaserJet Enterprise Color M553dn, a noncontact developing system, a print speed of 71 A4-size sheets per minute) manufactured by Hewlett-Packard Enterprise was modified into an evaluation machine, which was used to evaluate fogging (image fogging). The manufactured electrophotographic photoreceptor was fitted to a process cartridge for HP LaserJet Enterprise Color M553dn. An image with a printing rate of 1% was formed on 20,000 sheets of A4-size plain paper in an environment with a temperature of 30° C. and a relative humidity of 80% in an intermittent mode that stopped after the image was printed on every two sheets. Furthermore, a blank image was output for every 4,000 sheets, whereby image fogging was evaluated. Paper used was A4-size plain paper (GF-0081A4, produced by Canon Marketing Japan Inc.).

The reflectivity of each of standard paper and a white portion of a printed-out image was measured using "REFLECTOMETER MODEL TC-6DS" (manufactured by Tokyo Denshoku Co., Ltd.) and fog (reflectivity (%)) was calculated using an expression below. (A blue filter was used to measure the reflectivity.) Incidentally, for evaluation standards, the worst value through durability was judged in accordance with standards below.

Fog (reflectivity (%))=(reflectivity (%) of standard paper)−(reflectivity (%) of sample)

A: Fog was less than 0.8%.
B: Fog was 0.8% to less than 1.6%.
C: Fog was 1.6% to less than 2.1%.
D: Fog was 2.1% or more.

Evaluation of Electric Potential Change

The manufactured electrophotographic photoreceptor was fitted to a process cartridge for HP LaserJet Enterprise Color M553dn and was modified such that a potential probe (trade name: model 16000B-8, manufactured by TREK Japan KK.) could be fitted to a development position. Thereafter, the potential of a central portion (an about 130 mm position) of the electrophotographic photoreceptor was measured using a surface electrometer (trade name: model 344, manufactured by TREK Japan KK.). The light quantity of image exposure was set such that the surface potential of the electrophotographic photoreceptor was such that the initial dark-area potential ($Vd_0$) and the initial light-area potential ($Vl_0$) were −600 V and −150 V, respectively, in an environment with a temperature of 15° C. and a relative humidity of 10%. In the light quantity set in this state (a state in which the potential probe was present on a portion of a developing machine), 20,000 images were formed in the same manner as that used in the above evaluation of fogging, followed by measuring the light-area potential (V1) after repeated use. The electric potential change $\Delta Vl=Vl-Vl_0$ (unit: V) of the light-area potential is shown in the table.

Examples 2 to 6 and 9 to 14

An electrophotographic photoreceptor was manufactured in substantially the same manner as that used in Example 1 except that ethyltrimethoxysilane (a surface treatment agent for titanium oxide) used in Example 1 and an additive amount of five parts (a treatment amount of 5%) were changed as shown in the table, followed by evaluating fogging and electric potential change in the same manner as that used in Example 1. Results are shown in the table.

Example 7

An electrophotographic photoreceptor was manufactured in substantially the same manner as that used in Example 2 except that the rutile titanium oxide particles (an average primary particle size of 50 nm, produced by TAYCA Corporation) (a base material of surface-treated titanium oxide) used in Example 2 were changed to rutile titanium oxide particles (an average primary particle size of 50 nm, produced by TAYCA Corporation) surface-treated with silica-alumina, followed by evaluating fogging and electric potential change in the same manner as that used in Example 2. Results are shown in the table.

Example 8

An electrophotographic photoreceptor was manufactured in substantially the same manner as that used in Example 13 except that the rutile titanium oxide particles (an average primary particle size of 50 nm, produced by TAYCA Corporation) (a base material of surface-treated titanium oxide) used in Example 13 were changed to rutile titanium oxide particles (an average primary particle size of 50 nm, produced by TAYCA Corporation) surface-treated with silica-alumina, followed by evaluating fogging and electric potential change in the same manner as that used in Example 13. Results are shown in the table.

Example 15

An electrophotographic photoreceptor was manufactured in substantially the same manner as that used in Example 2 except that the rutile titanium oxide particles (an average primary particle size of 50 nm, produced by TAYCA Corporation) (a base material of surface-treated titanium oxide) used in Example 2 were changed to rutile titanium oxide particles (an average primary particle size of 80 nm, produced by TAYCA Corporation), an additive amount of five parts (a treatment amount of 5%) was changed as shown in the table, and the amount of surface-treated rutile titanium oxide particles used in the preparation of a dispersion was changed from 18 parts to 24 parts, followed by evaluating fogging and electric potential change in the same manner as that used in Example 2. Results are shown in the table.

Example 16

An electrophotographic photoreceptor was manufactured in substantially the same manner as that used in Example 2 except that the rutile titanium oxide particles (an average primary particle size of 50 nm, produced by TAYCA Corporation) (a base material of surface-treated titanium oxide) used in Example 2 were changed to rutile titanium oxide particles (an average primary particle size of 15 nm, produced by TAYCA Corporation), an additive amount of five parts (a treatment amount of 5%) was changed as shown in the table, and the amount of surface-treated rutile titanium oxide particles used in the preparation of a dispersion was changed from 18 parts to six parts, followed by evaluating fogging and electric potential change in the same manner as that used in Example 2. Results are shown in the table.

Example 17

An electrophotographic photoreceptor was manufactured in substantially the same manner as that used in Example 2 except that the amount of the surface-treated rutile titanium oxide particles used in the preparation of the dispersion in Example 2 was changed from 18 parts to 24 parts, followed by evaluating fogging and electric potential change in the same manner as that used in Example 2. Results are shown in the table.

Example 18

An electrophotographic photoreceptor was manufactured in substantially the same manner as that used in Example 2 except that the rutile titanium oxide particles (an average primary particle size of 50 nm, produced by TAYCA Corporation) (a base material of surface-treated titanium oxide) used in Example 2 were changed to rutile titanium oxide particles (an average primary particle size of 35 nm, produced by TAYCA Corporation) and the amount of surface-treated rutile titanium oxide particles used in the preparation of a dispersion was changed from 18 parts to 11.4 parts, followed by evaluating fogging and electric potential change in the same manner as that used in Example 2. Results are shown in the table.

Example 19

An electrophotographic photoreceptor was manufactured in substantially the same manner as that used in Example 2 except that the amount of the surface-treated rutile titanium oxide particles used in the preparation of the dispersion in Example 2 was changed from 18 parts to 27 parts, followed by evaluating fogging and electric potential change in the same manner as that used in Example 2. Results are shown in the table.

Example 20

An electrophotographic photoreceptor was manufactured in substantially the same manner as that used in Example 2 except that the amount of the surface-treated rutile titanium oxide particles used in the preparation of the dispersion in Example 2 was changed from 18 parts to six parts, followed by evaluating fogging and electric potential change in the same manner as that used in Example 2. Results are shown in the table.

Examples 21 to 24

An electrophotographic photoreceptor was manufactured in substantially the same manner as that used in Example 2 except that the thickness of the undercoat layer formed in Example 2 was changed as shown in the table, followed by evaluating fogging and electric potential change in the same manner as that used in Example 2. Results are shown in the table.

Example 25

An electrophotographic photoreceptor was manufactured in substantially the same manner as that used in Example 2 except that the rutile titanium oxide particles (an average primary particle size of 50 nm, produced by TAYCA Corporation) (a base material of surface-treated titanium oxide) used in Example 2 were changed to anatase titanium oxide particles (an average primary particle size of 30 nm, produced by TAYCA Corporation) and the amount of surface-treated rutile titanium oxide particles used in the preparation of a dispersion was changed from 18 parts to 12 parts, followed by evaluating fogging and electric potential change in the same manner as that used in Example 2. Results are shown in the table.

Example 26

An electrophotographic photoreceptor was manufactured in substantially the same manner as that used in Example 2 except that a conductive layer below was formed between the support and undercoat layer used in Example 2, followed by evaluating fogging and electric potential change in the same manner as that used in Example 2. Results are shown in the table.

A dispersion was prepared by adding 214 parts of titanium oxide particles coated with oxygen-deficient tin oxide and 132 parts of a phenol resin (trade name: Plyophen J-325, produced by DIC Corporation) to 50 parts of 1-methoxy-2-propanol serving as a solvent.

The dispersion was put in a vertical sand mill containing glass beads with a diameter of 1.0 mm and was subjected to dispersion treatment for three hours. After the glass beads were removed from the dispersion, 29 parts of silicone resin particles (trade name: Tospearl 120, produced by Momentive Performance Materials Japan LLC) and 0.03 parts of silicone oil (trade name: SH28PA, produced by Dow Corning Toray Co., Ltd.) were added to the dispersion, whereby a conductive layer coating solution was prepared. The conductive layer coating solution was applied to the support by dip coating, followed by drying an obtained coating film at 150° C. for 30 minutes, whereby the conductive layer was formed so as to have a thickness of 30 μm.

Example 27

An electrophotographic photoreceptor was manufactured in substantially the same manner as that used in Example 2 except that a conductive layer below was formed between the support and undercoat layer used in Example 2, followed by evaluating the electrophotographic photoreceptor in the same manner as that used in Example 2. Results are shown in the table.

A dispersion was prepared by adding 207 parts of titanium oxide particles coated with phosphorus-doped tin oxide and 144 parts of a phenol resin (trade name: Plyophen J-325, produced by DIC Corporation) to 98 parts of 1-methoxy-2-propanol serving as a solvent.

The dispersion was subjected to dispersion treatment for 4.5 hours in a vertical sand mill using glass beads with a diameter of 1.0 mm After the glass beads were removed from the dispersion, 44 parts of silicone resin particles (trade name: Tospearl 120, produced by Momentive Performance Materials Japan LLC) and 0.03 parts of silicone oil (trade name: SH28PA, produced by Dow Corning Toray Co., Ltd.) were added to the dispersion, whereby a conductive layer coating solution was prepared. The conductive layer coating solution was applied to the support by dip coating, followed by drying an obtained coating film at 150° C. for 30 minutes, whereby the conductive layer was formed so as to have a thickness of 30 μm.

Example 28

An electrophotographic photoreceptor was manufactured in substantially the same manner as that used in Example 2 except that a conductive layer below was formed between the support and undercoat layer used in Example 2, followed by evaluating the electrophotographic photoreceptor in the same manner as that used in Example 2. Results are shown in the table.

Core particles used were anatase titanium oxide particles with an average primary particle size of 200 nm. A titanium niobium-sulfuric acid solution containing 33.7 g of titanium in terms of $TiO_2$ and 2.9 g of niobium in terms of $Nb_2O_5$ was prepared. A suspension was prepared by dispersing 100 g of the core particles in 1 L of pure water and was heated to 60° C. The titanium niobium-sulfuric acid solution and a 10 mol/L aqueous solution of sodium hydroxide were added dropwise to the suspension over three hours such that the pH of the suspension was 2 to 3. After the whole was added, the pH of the suspension was adjusted to about 7 and a flocculant was added to the suspension, whereby solid matter was precipitated. A supernatant liquid was removed, followed by filtration, washing, and drying at 110° C., whereby an intermediate containing 0.1% by weight of organic matter derived from the flocculant in terms of C was obtained. The intermediate was calcined at 800° C. for one hour in a nitrogen gas, whereby metal oxide particles were prepared.

A dispersion was prepared by adding 100 parts of metal oxide particles and 80 parts of a phenol resin (trade name: Plyophen J-325, produced by DIC Corporation) to 60 parts of 1-methoxy-2-propanol serving as a solvent.

The dispersion was subjected to dispersion treatment for two hours in a vertical sand mill using glass beads with a diameter of 1.0 mm After the glass beads were removed from the dispersion, 15 parts of silicone resin particles (trade name: KMP-590, produced by Shin-Etsu Chemical Co., Ltd.) and 0.015 parts of silicone oil (trade name: SH28PA, produced by Dow Corning Toray Co., Ltd.) were added to the dispersion, whereby a conductive layer coating solution was prepared. The conductive layer coating solution was applied to the support by dip coating, followed by drying an obtained coating film at 150° C. for 30 minutes, whereby the conductive layer was formed so as to have a thickness of 30 μm.

Comparative Example 1

An electrophotographic photoreceptor was manufactured in substantially the same manner as that used in Example 1 except that ethyltrimethoxysilane (a surface treatment agent for titanium oxide) used in Example 1 was changed to methyltrimethoxysilane and the rutile titanium oxide particles (an average primary particle size of 50 nm, produced by TAYCA Corporation) (a base material of surface-treated titanium oxide) were changed to rutile titanium oxide particles (an average primary particle size of 35 nm, produced by TAYCA Corporation), followed by evaluating fogging and electric potential change in the same manner as that used in Example 1. Results are shown in the table.

Comparative Example 2

An electrophotographic photoreceptor was manufactured in substantially the same manner as that used in Example 1 except that ethyltrimethoxysilane (a surface treatment agent for titanium oxide) used in Example 1 was changed to hexyltrimethoxysilane and the rutile titanium oxide particles (an average primary particle size of 50 nm, produced by TAYCA Corporation) (a base material of surface-treated titanium oxide) were changed to rutile titanium oxide particles (an average primary particle size of 35 nm, produced by TAYCA Corporation), followed by evaluating fogging and electric potential change in the same manner as that used in Example 1. Results are shown in the table.

Comparative Example 3

An electrophotographic photoreceptor was manufactured in substantially the same manner as that used in Example 1 except that ethyltrimethoxysilane (a surface treatment agent for titanium oxide) used in Example 1 was changed to isobutyltrimethoxysilane, the rutile titanium oxide particles (an average primary particle size of 50 nm, produced by TAYCA Corporation) (a base material of surface-treated titanium oxide) were changed to rutile titanium oxide particles (an average primary particle size of 35 nm, produced by TAYCA Corporation), and a method for forming a charge generation layer was changed as described below, followed by evaluating fogging and electric potential change in the same manner as that used in Example 1. Results are shown in the table.

With reference to a method described in Japanese Patent Laid-Open No. 2003-262968, four parts of oxytitanylphthalocyanine having strong peaks at Bragg angles (2θ±0.2°) of 9.0°, 14.2°, 23.9°, and 27.1° in Cu Kα characteristic X-ray diffraction and two parts of polyvinyl butyral (trade name: S-LEC BM2, produced by Sekisui Chemical Co., Ltd.) were dispersed in 60 parts of cyclohexanone for four hours in a sand mill containing glass beads with a diameter of 1 mm, followed by adding 100 parts of ethyl acetate, whereby a charge generation layer coating solution was prepared. The charge generation layer coating solution was applied to an undercoat layer by dip coating, followed by drying an obtained coating film at 80° C. for ten minutes, whereby the charge generation layer was formed so as to have a thickness of 0.25 μm.

Comparative Example 4

An electrophotographic photoreceptor was manufactured in substantially the same manner as that used in Comparative Example 3 except that the rutile titanium oxide particles (an average primary particle size of 35 nm, produced by TAYCA Corporation) (a base material of surface-treated titanium oxide) used in Comparative Example 3 were changed to rutile titanium oxide particles (an average primary particle size of 50 nm, produced by TAYCA Corporation), followed by evaluating fogging and electric potential change in the same manner as that used in Example 1. Results are shown in the table.

Comparative Example 5

An electrophotographic photoreceptor was manufactured in substantially the same manner as that used in Comparative Example 3 except that the rutile titanium oxide particles (an average primary particle size of 35 nm, produced by TAYCA Corporation) (a base material of surface-treated titanium oxide) used in Comparative Example 3 were changed to rutile titanium oxide particles (an average primary particle size of 35 nm, produced by TAYCA Corporation) surface-treated with silica-alumina and isobutyltrimethoxysilane (a surface treatment agent for titanium oxide) was changed to hexyltrimethoxysilane, followed by evaluating fogging and electric potential change in the same manner as that used in Example 1. Results are shown in the table.

TABLE

| Examples | Charge generation material | Surface treatment agent for titanium oxide Formula | $R^{1-4}$ | $X^{1-4}$ | n | Conditions for forming undercoat layer Titanium oxide: Primary particle size a (μm) | Si content b (%) | Volume ratio c | Al content (%) | Surface treatment amount (%) |
|---|---|---|---|---|---|---|---|---|---|---|
| Example 1 | HOGaPc | (1) | $CH_3$ | — | 1 | 0.050 | 0.50 | 0.78 | 0.04 | 5 |
| Example 2 | HOGaPc | (1) | $CH_3$ | — | 2 | 0.050 | 0.42 | 0.78 | 0.04 | 5 |
| Example 3 | HOGaPc | (5) | $CH_3$ | $CH_3$ | 2 | 0.050 | 0.38 | 0.78 | 0.04 | 6 |
| Example 4 | HOGaPc | (1) | $CH_2CH_3$ | — | 2 | 0.050 | 0.36 | 0.78 | 0.04 | 6 |
| Example 5 | HOGaPc | (1) | $CH_3$ | — | 2 | 0.050 | 0.95 | 0.78 | 0.04 | 8 |
| Example 6 | HOGaPc | (1) | $CH_3$ | — | 2 | 0.050 | 0.20 | 0.78 | 0.04 | 2 |
| Example 7 | HOGaPc | (1) | $CH_3$ | — | 2 | 0.050 | 1.78 | 0.78 | 0.72 | 5 |
| Example 8 | HOGaPc | (3) | $CH_3$ | — | — | 0.050 | 1.70 | 0.78 | 0.72 | 5 |
| Example 9 | HOGaPc | (1) | $CH_3$ | — | 2 | 0.050 | 1.10 | 0.78 | 0.04 | 10 |
| Example 10 | HOGaPc | (1) | $CH_3$ | — | 2 | 0.050 | 0.13 | 0.78 | 0.04 | 1 |
| Example 11 | HOGaPc | (1) | $CH_3$ | — | 3 | 0.050 | 0.36 | 0.78 | 0.04 | 5 |
| Example 12 | HOGaPc | (2) | $CH_3$ | — | — | 0.050 | 0.37 | 0.78 | 0.04 | 5 |
| Example 13 | HOGaPc | (3) | $CH_3$ | — | — | 0.050 | 0.32 | 0.78 | 0.04 | 5 |
| Example 14 | HOGaPc | (4) | $CH_3$ | — | — | 0.050 | 0.35 | 0.78 | 0.04 | 5 |
| Example 15 | HOGaPc | (1) | $CH_3$ | — | 2 | 0.080 | 0.29 | 1.04 | 0.04 | 4 |
| Example 16 | HOGaPc | (1) | $CH_3$ | — | 2 | 0.015 | 1.56 | 0.26 | 0.04 | 12 |
| Example 17 | HOGaPc | (1) | $CH_3$ | — | 2 | 0.050 | 0.42 | 1.04 | 0.04 | 5 |
| Example 18 | HOGaPc | (1) | $CH_3$ | — | 2 | 0.035 | 0.42 | 0.49 | 0.04 | 5 |
| Example 19 | HOGaPc | (1) | $CH_3$ | — | 2 | 0.050 | 0.42 | 1.17 | 0.04 | 5 |
| Example 20 | HOGaPc | (1) | $CH_3$ | — | 2 | 0.050 | 0.42 | 0.26 | 0.04 | 5 |
| Example 21 | HOGaPc | (1) | $CH_3$ | — | 2 | 0.050 | 0.42 | 0.78 | 0.04 | 5 |
| Example 22 | HOGaPc | (1) | $CH_3$ | — | 2 | 0.050 | 0.42 | 0.78 | 0.04 | 5 |
| Example 23 | HOGaPc | (1) | $CH_3$ | — | 2 | 0.050 | 0.42 | 0.78 | 0.04 | 5 |
| Example 24 | HOGaPc | (1) | $CH_3$ | — | 2 | 0.050 | 0.42 | 0.78 | 0.04 | 5 |
| Example 25 | HOGaPc | (1) | $CH_3$ | — | 2 | 0.030 | 0.51 | 0.52 | 0.1 | 5 |
| Example 26 | HOGaPc | (1) | $CH_3$ | — | 2 | 0.050 | 0.42 | 0.78 | 0.04 | 5 |
| Example 27 | HOGaPc | (1) | $CH_3$ | — | 2 | 0.050 | 0.42 | 0.78 | 0.04 | 5 |
| Example 28 | HOGaPc | (1) | $CH_3$ | — | 2 | 0.050 | 0.42 | 0.78 | 0.04 | 5 |
| Comparative Example 1 | HOGaPc | Methyltrimethoxysilane | | | | 0.035 | 0.31 | 0.78 | 0.12 | 5 |
| Comparative Example 2 | HOGaPc | Hexyltrimethoxysilane | | | | 0.035 | 0.23 | 0.78 | 0.12 | 5 |
| Comparative Example 3 | TiOPc | Isobutyltrimethoxysilane | | | | 0.035 | 0.30 | 0.78 | 0.12 | 5 |
| Comparative Example 4 | TiOPc | Silica-alumina treatment/ isobutyltrimethoxysilane | | | | 0.050 | 1.70 | 1.04 | 0.69 | 5 |
| Comparative Example 5 | TiOPc | Silica-alumina treatment/ hexyltrimethoxysilane | | | | 0.035 | 2.32 | 0.78 | 0.95 | 5 |

| Examples | Conditions for forming undercoat layer: Thickness d (μm) | Expression (A) a × b | Expression (B) c/a | Expression (C) c/d | Evaluation results: Fogging | Electric potential change ΔVI |
|---|---|---|---|---|---|---|
| Example 1 | 2.0 | 0.025 | 15.6 | 0.39 | A | 22 |
| Example 2 | 2.0 | 0.021 | 15.6 | 0.39 | A | 19 |
| Example 3 | 2.0 | 0.019 | 15.6 | 0.39 | B | 31 |
| Example 4 | 2.0 | 0.018 | 15.6 | 0.39 | B | 33 |
| Example 5 | 2.0 | 0.048 | 15.6 | 0.39 | A | 32 |
| Example 6 | 2.0 | 0.010 | 15.6 | 0.39 | A | 20 |
| Example 7 | 2.0 | 0.089 | 15.6 | 0.39 | B | 60 |
| Example 8 | 2.0 | 0.085 | 15.6 | 0.39 | B | 61 |
| Example 9 | 2.0 | 0.055 | 15.6 | 0.39 | A | 29 |
| Example 10 | 2.0 | 0.007 | 15.6 | 0.39 | B | 20 |
| Example 11 | 2.0 | 0.018 | 15.6 | 0.39 | A | 41 |
| Example 12 | 2.0 | 0.019 | 15.6 | 0.39 | B | 52 |
| Example 13 | 2.0 | 0.016 | 15.6 | 0.39 | B | 51 |
| Example 14 | 2.0 | 0.018 | 15.6 | 0.39 | B | 53 |
| Example 15 | 2.0 | 0.023 | 13.0 | 0.52 | B | 42 |
| Example 16 | 2.0 | 0.023 | 17.3 | 0.13 | B | 39 |
| Example 17 | 2.0 | 0.021 | 20.8 | 0.52 | A | 21 |
| Example 18 | 2.0 | 0.015 | 14.1 | 0.25 | A | 32 |
| Example 19 | 2.0 | 0.021 | 23.4 | 0.58 | B | 22 |
| Example 20 | 2.0 | 0.021 | 5.2 | 0.13 | A | 43 |
| Example 21 | 3.0 | 0.021 | 15.6 | 0.26 | A | 33 |
| Example 22 | 0.5 | 0.021 | 15.6 | 1.56 | A | 22 |
| Example 23 | 3.5 | 0.021 | 15.6 | 0.22 | A | 41 |
| Example 24 | 0.3 | 0.021 | 15.6 | 2.60 | B | 22 |
| Example 25 | 2.0 | 0.015 | 17.3 | 0.26 | B | 23 |
| Example 26 | 2.0 | 0.021 | 15.6 | 0.39 | A | 24 |
| Example 27 | 2.0 | 0.021 | 15.6 | 0.39 | A | 26 |
| Example 28 | 2.0 | 0.021 | 15.6 | 0.39 | A | 16 |

TABLE-continued

| | | | | | | |
|---|---|---|---|---|---|---|
| Comparative Example 1 | 2.0 | 0.011 | 22.3 | 0.39 | D | 32 |
| Comparative Example 2 | 2.0 | 0.008 | 22.3 | 0.39 | D | 40 |
| Comparative Example 3 | 2.0 | 0.011 | 22.3 | 0.39 | D | 33 |
| Comparative Example 4 | 2.0 | 0.085 | 20.8 | 0.52 | C | 63 |
| Comparative Example 5 | 2.0 | 0.081 | 22.3 | 0.39 | C | 81 |

According to the present disclosure, an electrophotographic photoreceptor which suppresses an electric potential change due to long-term repeated use and fogging and which suppresses the toner consumption amount, a process cartridge including the electrophotographic photoreceptor, and an electrophotographic apparatus are provided.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-026909, filed Feb. 18, 2019 and Japanese Patent Application No. 2020-011253, filed Jan. 27, 2020, which are hereby incorporated by reference herein in their entirety.

What is claimed is:

1. An electrophotographic photoreceptor comprising:

a support;

an undercoat layer placed on the support;

a charge generation layer placed on the undercoat layer; and a charge transport layer placed on the charge generation layer, wherein the undercoat layer contains titanium oxide particles surface-treated with an organosilicon compound that is at least one member selected from the group consisting of compounds represented by formulas (1) to (8) and a polyamide resin and the charge generation layer contains hydroxygallium phthalocyanine:

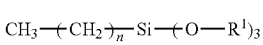

(1)

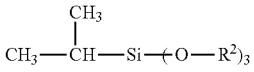

(2)

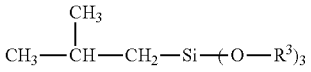

(3)

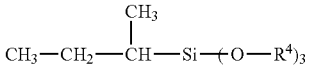

(4)

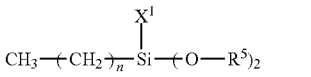

(5)

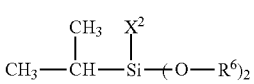

(6)

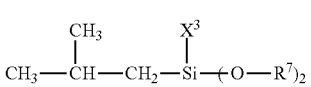

(7)

-continued

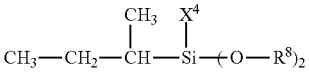

(8)

in formulas (1) to (8), $R^1$ to $R^8$ each independently represent a methyl group, an ethyl group, or an acetyl group; $X^1$ to $X^4$ each independently represent a hydrogen atom or a methyl group; and n represents an integer of 1 to 3.

2. The electrophotographic photoreceptor according to claim 1, wherein the hydroxygallium phthalocyanine is a hydroxygallium phthalocyanine crystal having peaks at Bragg angles (2θ±0.2°) of 7.4° and 28.3° in Cu Kα characteristic X-ray diffraction.

3. The electrophotographic photoreceptor according to claim 1, wherein the titanium oxide particles surface-treated with the organosilicon compound are treated with no alumina or when the titanium oxide particles surface-treated with the organosilicon compound are treated with alumina, the abundance of Al is 0.50% or less.

4. The electrophotographic photoreceptor according to claim 1, wherein in the undercoat layer, the following expression is satisfied:

$$0.010 \leq a \times b \leq 0.050 \quad (A)$$

where b (%) is the element ratio of Si in the organosilicon compound to Ti in the titanium oxide particles and a (μm) is the average primary particle size of the titanium oxide particles surface-treated with the organosilicon compound.

5. The electrophotographic photoreceptor according to claim 1, wherein the organosilicon compound is the compound represented by formula (1) or (5).

6. The electrophotographic photoreceptor according to claim 5, wherein n in formula (1) or (5) is 1 or 2.

7. The electrophotographic photoreceptor according to claim 1, wherein in the undercoat layer, the following expression is satisfied:

$$14.0 \leq c/a \leq 21.0 \quad (B)$$

where c is the volume ratio of the titanium oxide particles surface-treated with the organosilicon compound to the polyamide resin.

8. The electrophotographic photoreceptor according to claim 1, wherein the following expression is satisfied:

$$0.5 \leq d \leq 3.0 \quad (C)$$

where d is the thickness (μm) of the undercoat layer.

9. The electrophotographic photoreceptor according to claim 8, wherein the undercoat layer satisfies the following expression:

$$0.15 \leq c/d \leq 0.55 \quad (D).$$

10. The electrophotographic photoreceptor according to claim 1, wherein the titanium oxide particles are rutile titanium oxide particles.

11. A process cartridge comprising:

the electrophotographic photoreceptor and at least one member selected from the group consisting of a charging unit, a developing unit, and a cleaning unit, the process cartridge integrally supporting the electrophotographic photoreceptor and at least one selected from the group consisting of the charging unit, the developing unit, and the cleaning unit, the process cartridge being attachable to or detachable from a main body of an electrophotographic apparatus, wherein the electrophotographic photoreceptor comprising:

a support;

an undercoat layer placed on the support;

a charge generation layer placed on the undercoat layer; and a charge transport layer placed on the charge generation layer, wherein the undercoat layer contains titanium oxide particles surface-treated with an organosilicon compound that is at least one member selected from the group consisting of compounds represented by formulas (1) to (8) and a polyamide resin and the charge generation layer contains hydroxygallium phthalocyanine:

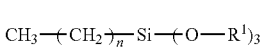

(1)

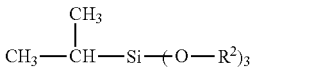

(2)

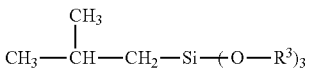

(3)

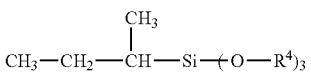

(4)

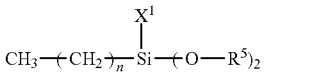

(5)

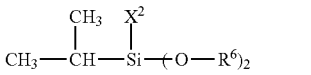

(6)

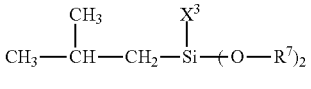

(7)

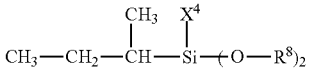

(8)

in formulas (1) to (8), $R^1$ to $R^8$ each independently represent a methyl group, an ethyl group, or an acetyl group; $X^1$ to $X^4$ each independently represent a hydrogen atom or a methyl group; and n represents an integer of 1 to 3.

12. An electrophotographic apparatus comprising:

the electrophotographic photoreceptor a charging unit;

an exposure unit;

a developing unit; and a transfer unit, wherein the electrophotographic photoreceptor comprising:

a support;

an undercoat layer placed on the support;

a charge generation layer placed on the undercoat layer; and a charge transport layer placed on the charge generation layer, wherein the undercoat layer contains titanium oxide particles surface-treated with an organosilicon compound that is at least one member selected from the group consisting of compounds represented by formulas (1) to (8) and a polyamide resin and the charge generation layer contains hydroxygallium phthalocyanine:

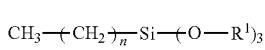

(1)

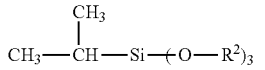

(2)

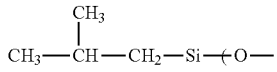

(3)

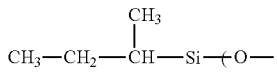

(4)

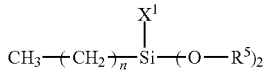

(5)

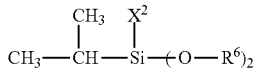

(6)

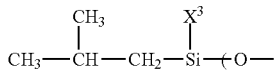

(7)

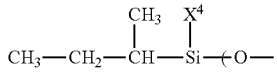

(8)

in formulas (1) to (8), $R^1$ to $R^8$ each independently represent a methyl group, an ethyl group, or an acetyl group; $X^1$ to $X^4$ each independently represent a hydrogen atom or a methyl group; and n represents an integer of 1 to 3.

* * * * *